US006874766B2

(12) United States Patent
Curatolo

(10) Patent No.: US 6,874,766 B2
(45) Date of Patent: Apr. 5, 2005

(54) PLASTIC DECK RAILING

(75) Inventor: Tony Curatolo, Woodbridge (CA)

(73) Assignee: Royal Group Technologies Limited, Woodbridge ( * ) Notice: Subject to any disclaimer, the term of this patent is extended or adjusted under 35 U.S.C. 154(b) by 35 days.

(21) Appl. No.: 10/241,641

(22) Filed: Sep. 12, 2002

(65) Prior Publication Data

US 2004/0051092 A1 Mar. 18, 2004

(51) Int. Cl.[7] ..... E04H 17/14

(52) U.S. Cl. ..... 256/59; 256/63; 256/64; 256/66; 256/65.02; 256/65.03; 256/65.04; 256/65.06; 256/65.07; 256/65.08

(58) Field of Search ..... 256/19, 20, 63, 256/64, 66, 65.02–65.08, 65.1, 65.11, 65.14–64.15, 159

(56) References Cited

U.S. PATENT DOCUMENTS 3,385,567 A * 5/1968 Case et al. ..... 256/24
3,506,243 A * 4/1970 Seiler ..... 256/59
3,756,567 A * 9/1973 Murdock ..... 256/21
4,390,165 A * 6/1983 Murdock ..... 256/24
4,705,155 A * 11/1987 Kanamori ..... 198/335
4,809,955 A * 3/1989 Veilleux ..... 256/65.02
5,544,866 A * 8/1996 Dye ..... 256/69
5,713,171 A * 2/1998 Andres ..... 52/263
5,853,167 A * 12/1998 West et al. ..... 256/66
6,398,193 B1 * 6/2002 DeSouza ..... 256/19
6,698,726 B2 * 3/2004 Platt ..... 256/59

* cited by examiner

*Primary Examiner*—Jeanette E. Chapman

(57) ABSTRACT

A deck railing section comprises synthetic posts held spaced from one another by top and bottom rail members. Each of the rail members has a multiple piece construction including first and second interlocking synthetic rail pieces and a metallic reinforcing insert. The insert has holes at post attachment locations along the insert. Each post has screw ports to opposite ends of the post. Rail members are secured to the posts by threaded attachment members passing through the holes in the inserts and into the screw ports of the posts. The first rail pieces are trapped between the posts and the inserts. The second rail pieces lock onto the first rail pieces hiding the reinforcing inserts internally of the rail members.

9 Claims, 6 Drawing Sheets

PLASTIC DECK RAILING

FIELD OF THE INVENTION

The present invention relates to a synthetic e.g. plastic deck railing preferably for use with a plastic deck.

BACKGROUND OF THE INVENTION

Decks made of synthetic material i.e., material other than wood are becoming ever more popular. These decks are easily made to very exact dimensions, are easily assembled and are very low in maintenance.

To date there has been very little in the way of development with respect to a deck railing suited for use with a synthetic deck.

SUMMARY OF THE PRESENT INVENTION

The present invention does provide a deck railing particularly suited for use with a plastic or other synthetic material deck.

More particularly, the present invention relates to a deck railing section which can either form the entire length of a deck railing or which can be used with other deck railing sections in forming an overall deck railing.

The deck railing section of the present invention comprises synthetic posts which are held spaced from one another by top and bottom rail members of the deck railing section. Each of the rail members has a multiple piece construction including first and second interlocking synthetic rail pieces and a metallic reinforcing insert within each rail member. The reinforcing insert has holes provided through the insert at post attachment locations along the insert. Each post has screw ports to opposite ends of the post. The rail members are secured to the posts by threaded attachment members which pass through the holes in the inserts and thread into the screw ports of the post. The first rail pieces of each rail member are trapped between the posts and the reinforcing inserts and the second pieces of the rail members lock onto the first pieces of the rail members hiding the reinforcing inserts internally of the rail members.

As will be understood from the description above the bulk of the construction of the deck railing section is made of synthetic material complimentary to a synthetic deck in association with which the deck railing section is preferably used. Added to that synthetic construction are metallic reinforcing inserts hidden internally of the rail members. These inserts add strength to the overall deck railing section without being visibly apparent in the construction of the railing.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
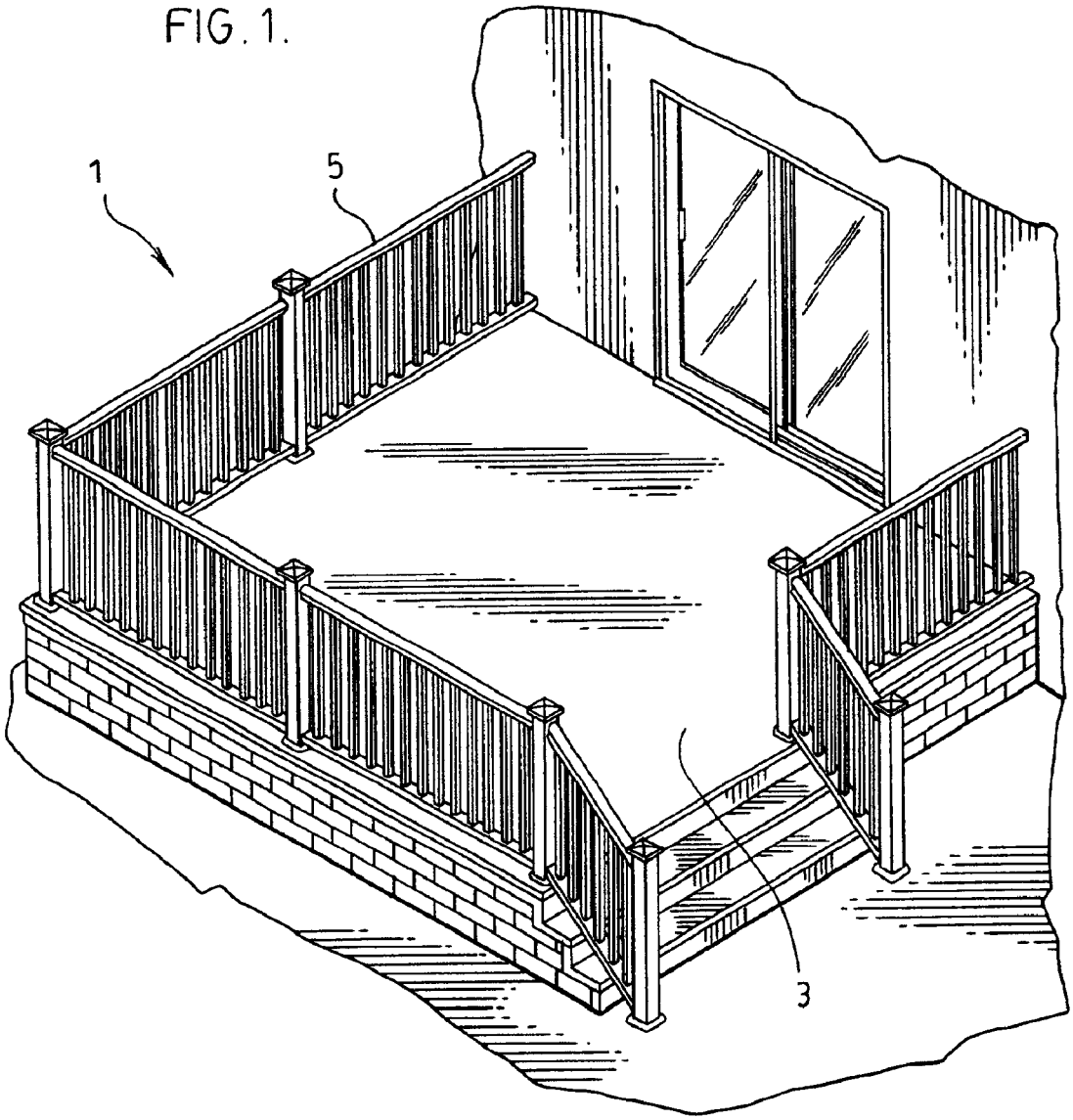
FIG. 1 is perspective view of a deck surrounded by a synthetic deck railing according to a preferred embodiment of the present invention.

FIG. 1 shows an overall deck assembly generally indicated at 1. This assembly includes the actual deck or platform 3 which is preferably made from a plastic material to receive a deck railing generally indicated at 5. This deck railing according to the present invention also has a substantially synthetic construction.

Figure 2:
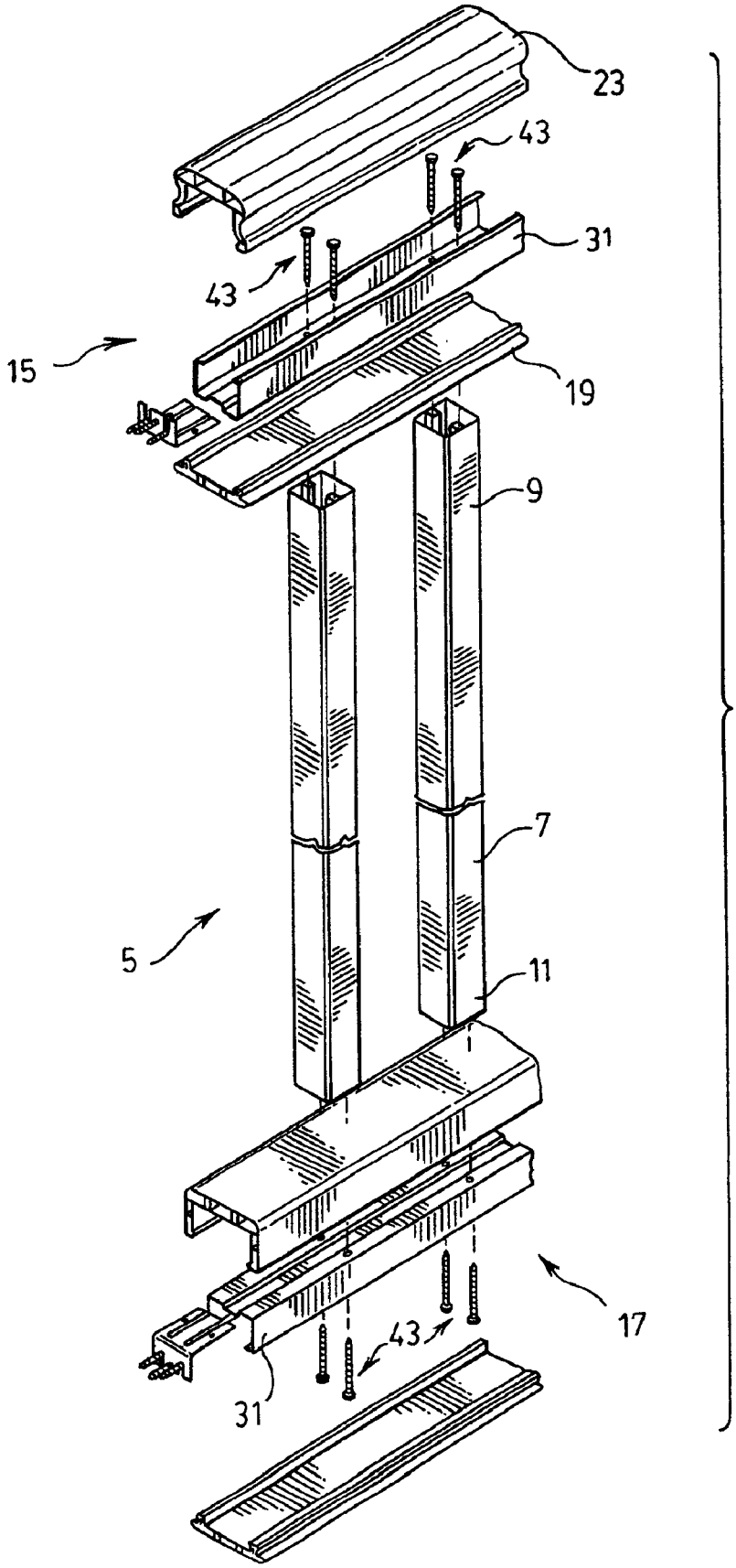
FIG. 2 is an exploded perspective view of part of the deck rail section of FIG. 1.

FIG. 2 shows the components of the deck railing 5 of the FIG. 1. These components comprise vertical newel posts 7. These posts have a fully synthetic construction and are preferably formed from a polyvinyl chloride based plastic material which may further include outdoor weathering materials as are known in the art to help strengthen and control expansion and contraction of the PVC.

Posts 7 are preferably formed in an extrusion process. According to this extrusion process the post are substantially hollow and include screw ports 13 internally of the opposite ends 9 and 11 of the posts. Each post is symmetrical over its entire length with the reference numeral 9 only being used to designate the upper end of the post and the reference numeral 11 being to designate the lower end of the post. As is to be understood, both ends of the post are identical and each post may be used in a position reversed to what is shown in the drawings.

The posts are preferably formed as part of a continuous length of post and then cut to the desired length for the particular deck railing application.

Secured atop the posts is a top rail member generally indicated at 15. A bottom rail member generally indicated at 17 is provided beneath the posts.

The top rail member 15 is formed by first and second rail pieces 19 and 23 respectively. These rail pieces again have a plastic e.g. PVC construction and are preferably made by extruding a continuous length of each rail piece cut to a specific length for a particular job application.

Provided internally of the upper rail member is a metallic reinforcing insert 31. This insert as well seen in FIGS. 3 and 6 of the drawings has a channel shape. This channel shape includes a tiered channel base formed by a center tier 37 which is vertically offset from i.e. raised relative to outside tiers 39 to each side of the center tier.

Extending upwardly from the tiers 39 of the insert are channel walls 33. Short returns 35 are provided at the ends of the channel walls.

Figure 4:
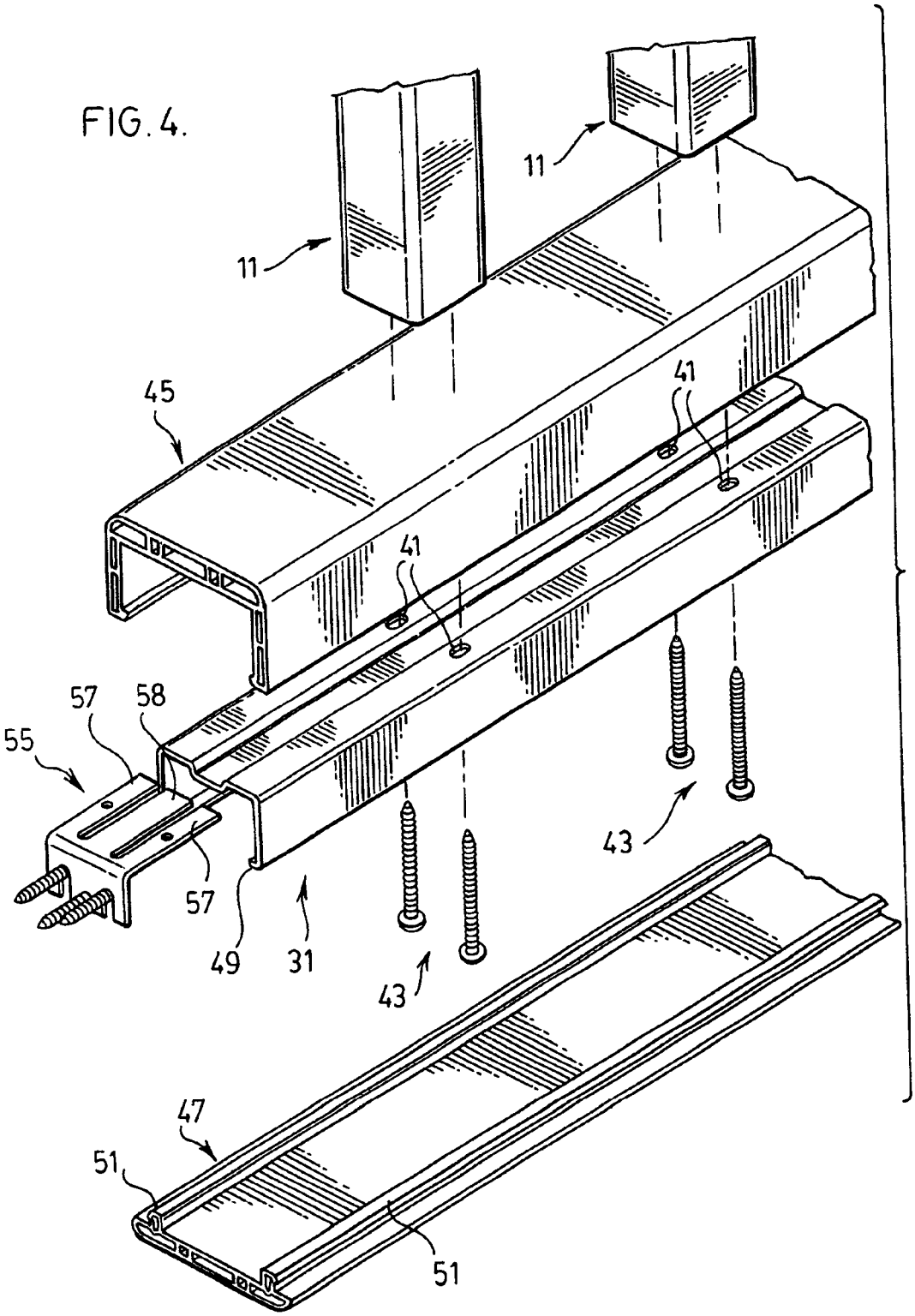
FIG. 4 is an enlarged perspective view of the lower rail member ready for attachment to the posts of the construction of FIG. 2.
Figure 5:
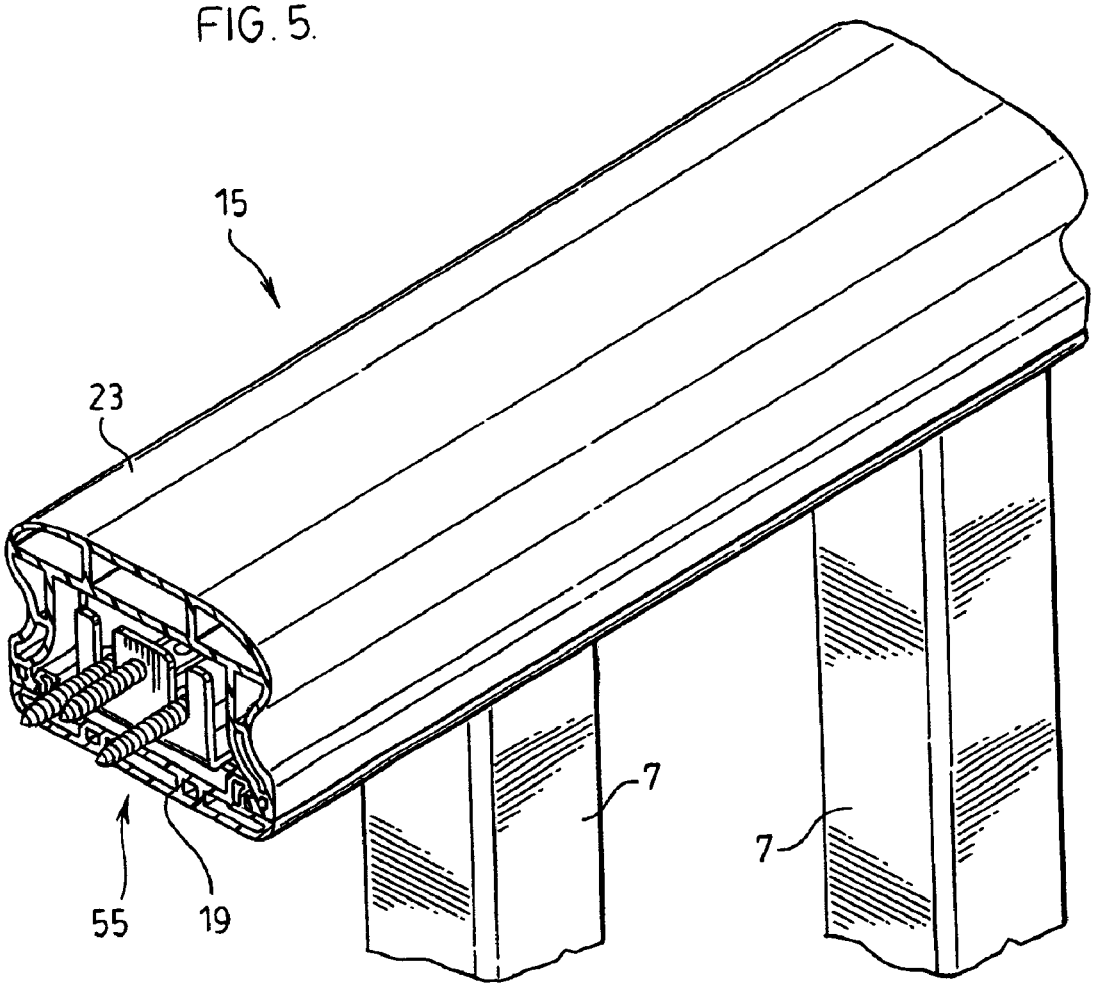
FIG. 5 shows the deck rail components of FIG. 3 in an assembled condition.

The identical insert reversed in it vertical orientation is used in the lower rail member as to be described with respect to FIG. 4 of the drawings. However, as it will be seen with respect to FIG. 4 the insert includes a pair of holes 41 in the outer tiers 39 of the channel base. These holes 41 are provided in groups of pairs spaced from one another along the insert. The provision of the holes 41 is identical between the inserts of the top and the bottom rails.

Figure 6:
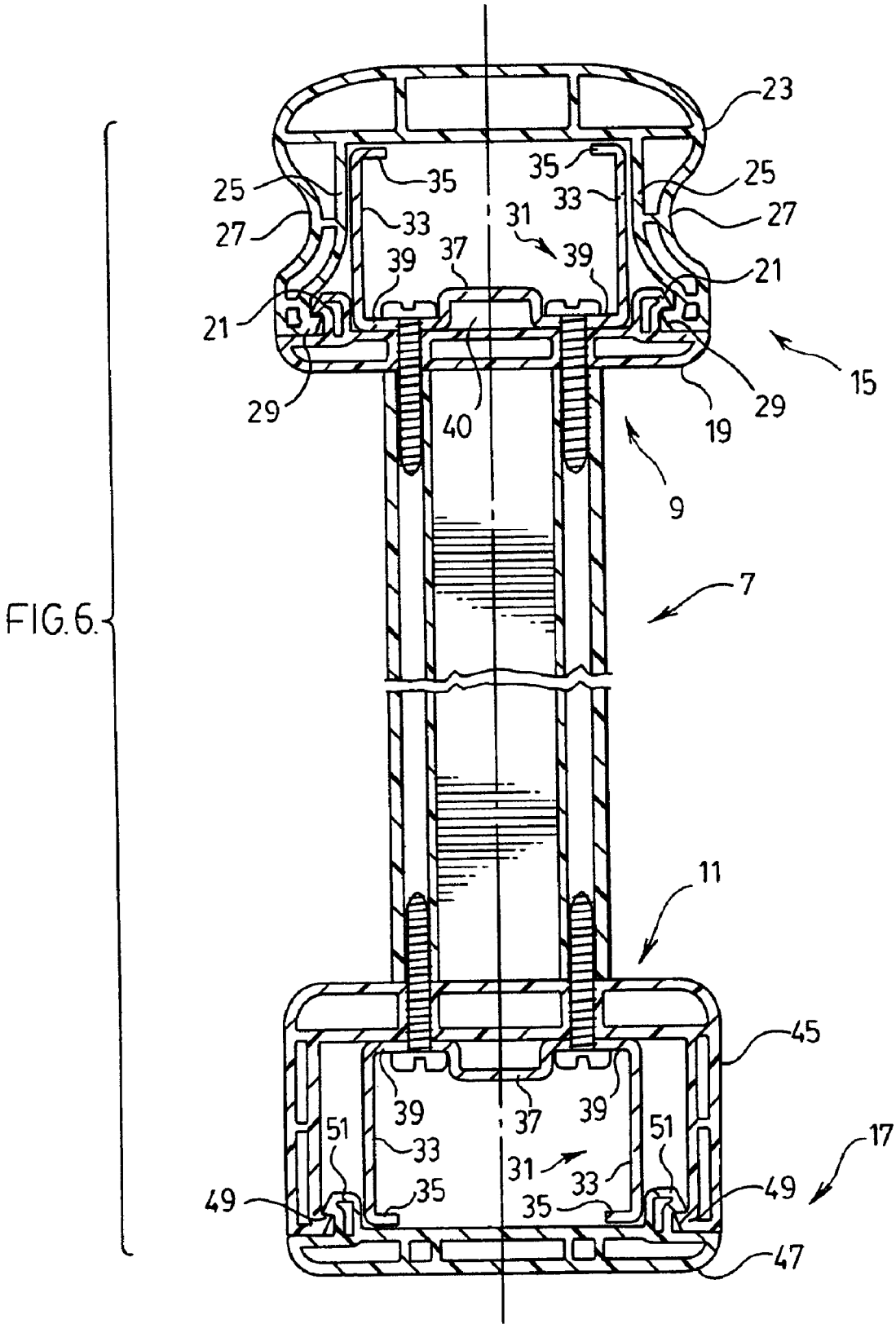
FIG. 6 is an end view through the construction of FIG. 2 when in an assembled condition.

Returning to FIG. 3 of the drawings it will be seen that the first rail piece 19 of the top rail member includes outwardly facing undercut tabs 21. The second rail piece includes inwardly directed undercut tabs 29. FIG. 6 of the drawings shows how the undercut tabs 21 and 29 interlock with one another to secure the first and second pieces of the top rail together.

Before interlocking these rail pieces with one another mechanical fasteners 43 are fitted through the openings 41 in the insert 31 of the top rail member. These mechanical fasteners also penetrate the first rail piece 19 before threading into the screw ports 13 at the uppers ends 9 of the posts 7. This provides a securing of the inserts with the posts with the first rail piece being trapped between the inserts and the posts.

In order to complete the assembly of the upper rail member the second rail piece 23 which provides a decorative cap is then interlocked with the first rail piece. This is preferably done by snapping the two rail pieces together with one another at their interlocking tabs.

FIG. 6 of the drawings clearly shows that the metallic insert 31 in the upper rail member 15 adds to the strength of the interlock between the two rail pieces 19 and 23. More specifically, the insert applies an outward pressure on the interlocking tabs 21 of the first rail piece 19 biasing them outwardly into locking engagement with the inwardly directed locking tabs 29 on the second rail piece. This provides an enhancement of the interlocking action of the two rail pieces in the upper rail member.

FIG. 6 shows a number of other features provided by the metallic insert 31. In addition to strengthening the overall upper rail member the channel walls 31 of the insert are located directly against the interior surfaces of the decorative side walls 27 of rail piece or cap 23. This precludes the decorative arcuate shaping of the side walls from collapsing inwardly as they would normally be likely to do under pressure applied to the top of the rail member. If such inward collapsing were allowed in the area of the side walls it would have a tendency to push the interlocking tabs 29 outwardly away from the interlocking tabs 21 of the rail member. However, because the insert spans the internal width of the upper rail member this is not a problem.

The insert also spans the internal height of the generally hollow rail member. This in combination with the interned ends 35 of the insert prevents the cap 23 from compressing under external pressure downwardly towards the base piece 19 of the upper rail member. The inturned ends 35 of the insert also eliminates any local piercing contact of the upper end of the insert with the interior wall of the cap 23.

The tiered configuration of the channel base of the insert adds a number of benefits. Firstly, the fact that the two outer tiers are lower than the centered tier enables a much deeper threading of the fastening screws bolts 43 into the posts from the insert. Furthermore, the channel base of the insert is strengthened by its corrugated configuration relative to a flat wall configuration. Finally, the gap 40 as seen in FIG. 6 of the drawings between the center tier of the channel base and the interior surface of rail piece 19 provides a drainage passage for any moisture which is able to get to the interior of the top rail member.

The assembly of the bottom rail member with the posts is best seen having reference to FIGS. 4 and 6 of the drawings. More specifically, the bottom rail member comprises a first rail piece 45 and a second rail piece 47. Like the top rail member the two pieces of the bottom rail member have a synthetic preferably extruded plastic construction. In fact, the second rail piece 47 of the bottom rail member preferably has an identical construction to the first rail piece 19 of the top rail member. These two pieces are therefore interchangeable with one another.

As earlier described, the metallic insert 31 of the bottom rail member is the same as the metallic insert in the top rail member except that it is in an inverted or upside down position relative to the top insert.

In order to ease assembly of the bottom rail member with the posts the parts are inverted from their regular use position, i.e., the posts are turned upside down and the bottom rail member is connected to the posts as if it were the top rail member. In order to do this the threaded mechanical fasteners 43 of the bottom rail member are fitted through the openings 41 of the bottom insert and screwed into the screw port at the bottom ends 11 of the posts. Rail piece 45 is trapped between the insert and the bottom ends of the posts. Rail piece 47 which in this case acts a bottom cap is then interlocked with rail piece 45 hiding the metal insert interiorly of the bottom rail member.

Rail piece 45 includes undercut interlocking tabs 49 and rail piece 47 includes undercut interlocking tabs 51. The tabs on the two rail pieces provide a snap lock assembly of the lower rail member. The ends of the channel legs 33 apply outward pressure on the locking tabs 51 to enhance the interlocking action of these tabs with the tabs 49 of rail piece 45.

Consistent with the upper rail the shape of the insert in the lower rail member provides benefits to the construction such as for example, the strengthening of the insert and the rail member by the provision of the tiered channel base which again provides a moisture drainage channel from the lower rail member.

The first piece 45 of the lower rail member although being different in shape from the second piece 23 of the upper rail member again has a decorative appearance. Therefore if one wants either the upper or lower rail member to have a different appearance the rail pieces 23 and 45 are interchangeable with one another or both the upper and lower rail members could use rail pieces having the shape of rail piece 23 or rail pieces having the shape of rail piece 45.

Figure 3:
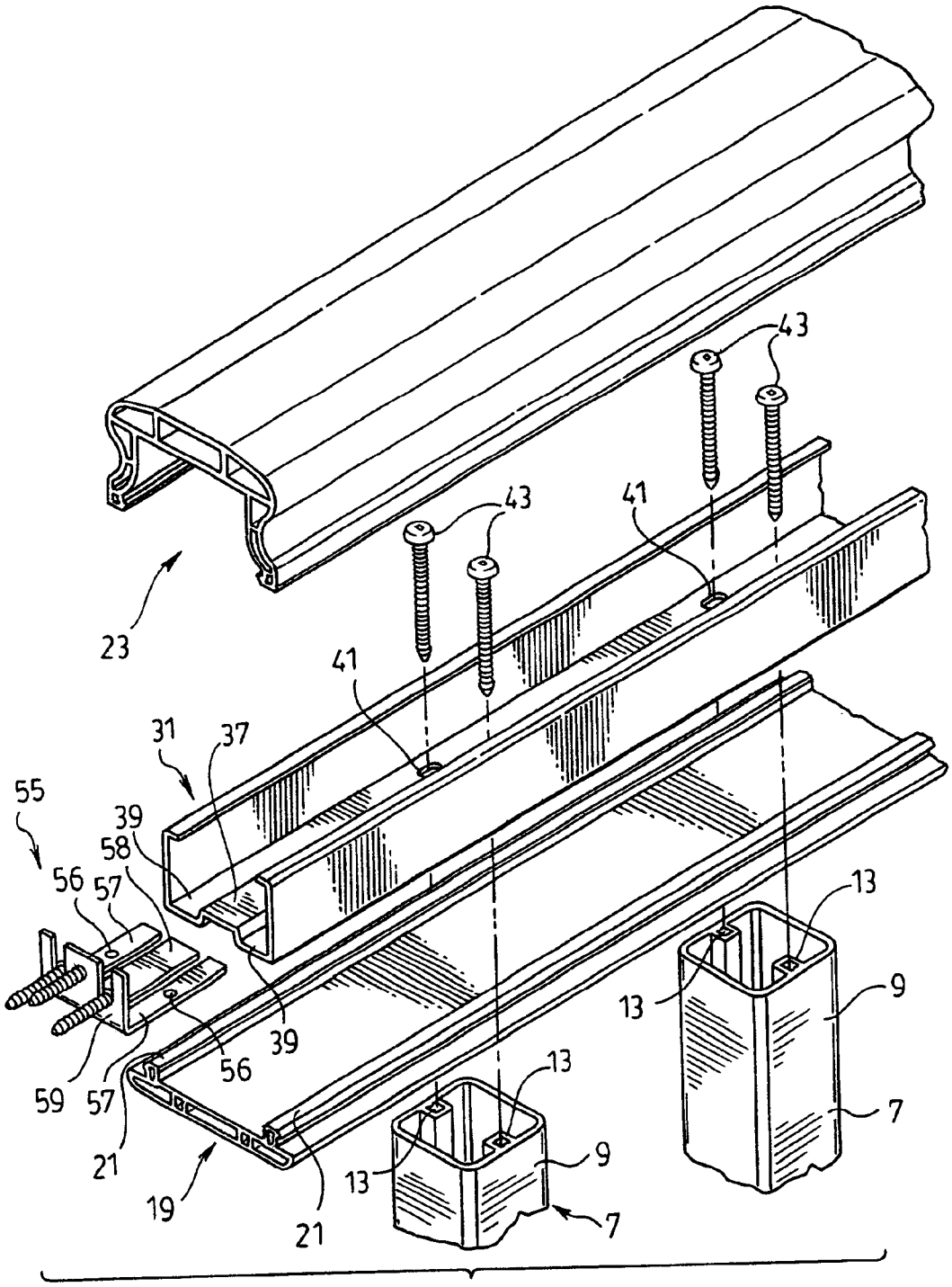
FIG. 3 is an enlarged perspective view of the upper rail member prepared for attachment to the posts of the construction of FIG. 2.

FIGS. 2, 3 and 4 show a further feature of the deck railing according to another preferred embodiment of the present invention. This feature is in the form of a connector generally indicated at 55 which secures to either one of the inserts in the top and bottom rail members to provide attachments to the end of the rail section. These attachments can be in the form of further rail sections for expanding the length of the railing or they can be attachments to a support such as the newel posts for the railing. When the attachments are made the connectors are once again hidden inside the rail members.

Connector 55 is specifically designed to cooperate with the shape of the metallic insert within each of the rail members. More particularly, connector 55 has an L shaped configuration comprising a first arm formed by tines 57 and 58. These tines are separated by small open ended slots which allow the two tines 57 to overlay the tiers 39 of the insert and which further allow the center tine 58 to fit into the open channel between tiers 39 and lay against tier 37 of the insert. This provides vertical support for the connector. As shown the tines 57 includes a small opening 56 which allows screws to be fitted through these tines for positively attaching the connector to the insert.

The connector includes a further arm 59 at right angles to the tined arm. Arm 59 is fitted with mechanical fasteners as shown to make the connection to the support structure or to a further railing section. This connection is made at both the upper and lower rail members.

In some setups, there will be no connection made to end of the railing section in which case connectors 55 are replaced with end caps. These end caps have the same tined arm as the connector but having a finished or capped arm to replace arm 59 of the connector.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A deck railing section comprising synthetic side by side newel posts held spaced from one another by top and bottom rail members, each of said rail members having a multiple piece construction including first and second interlocking synthetic rail pieces and a metallic reinforcing insert, the reinforcing insert having holes therein at post attachment locations therealong, each post having screw ports to opposite ends thereof, the rail members being secured to the posts by threaded attachment members passing in a vertical direction through the holes in the inserts and into the screw ports of the posts with the first rail pieces being penetrated by the threaded attachment members and thereby trapped between the posts and the inserts, the second rail pieces locking onto the first rail pieces of the rail members biding the reinforcing inserts internally of the rail members.

2. A deck railing section as claimed in claim 1 wherein each rail member has a generally hollow construction with an internal space between the first and second pieces of each rail member, the reinforcing insert having a height to span the internal recess of each rail member.

3. A deck railing section as claimed in claim 2 wherein the first and second pieces of each rail member having interlocking undercut tabs, the reinforcing insert in each rail member applying pressure to enhance the interlocking of the tabs of the first and second pieces of the rail members.

4. A deck railing Section as claimed in claim 1 wherein the holes in the reinforcing inserts are provided in groups of pairs spaced along each insert, each end of each post being provided two of said screw ports, one to each side of each end of each post.

5. A deck railing section as claimed in claim 4 wherein each reinforcing insert has a channel shape which includes a channel base and channel legs, the channel base having a tiered construction including a center tier vertically offset from outer tiers to opposite sides of said center tier, said groups of pairs of holes being provided in the other tiers of the channel base.

6. A deck railing section as claimed in claim 5 including metallic connectors for connecting said deck railing section with another structure, the metallic connectors being provided internally of and hidden within the rail members.

7. A deck railing section as claimed in claim 6 wherein said metallic connectors are L shaped having first and second arms perpendicular to one another, the first arm having a tined construction to interlock with the tiered construction of the channel base of the reinforcing insert.

8. A deck railing section as claimed in claim 7 wherein the second arm of each connector is provided with mechanical fasteners for attachment to a corresponding connector of a further deck railing section to a support for said deck railing section.

9. A deck railing section as claimed in claim 1 wherein each of said posts has an extruded construction, said construction including said screw ports which are an integral part of each of said posts and which are hidden interiorly of each of said posts.

* * * * *